US006401736B1

(12) United States Patent
Jerry

(10) Patent No.: US 6,401,736 B1
(45) Date of Patent: Jun. 11, 2002

(54) UMBRELLA DEVICE WITH ENGAGING MECHANISM

(76) Inventor: Alex Jerry, 4205 W. Pine River Rd., St. Louis, MI (US) 48880

( * ) Notice: Subject to any disclaimer, the term of this patent is extended or adjusted under 35 U.S.C. 154(b) by 0 days.

(21) Appl. No.: 09/642,320

(22) Filed: Aug. 21, 2000

(51) Int. Cl.[7] ..... A45B 19/06

(52) U.S. Cl. ..... 135/25.1; 135/70.3; 135/25.4; 135/28; 135/40; 135/41; 403/110; 403/109.1

(58) Field of Search ..... 135/20.3, 25.1, 135/25.4, 28, 40, 41, 98; 403/110, 109.1, 104

(56) References Cited

U.S. PATENT DOCUMENTS

| | | | | | |
|---|---|---|---|---|---|
| 232,213 | A | * | 9/1880 | Shemeley | 135/98 |
| 336,363 | A | * | 2/1886 | Ward | 135/98 |
| 554,792 | A | * | 2/1896 | Pittenger et al. | 135/20.3 |
| 595,628 | A | * | 12/1897 | Holman | 135/98 |
| 1,117,382 | A | * | 11/1914 | Hirtz | 135/25.1 |
| 2,096,638 | A | * | 10/1937 | Higgins, Jr. | 403/110 |
| 2,183,833 | A | * | 12/1939 | Farhar | 135/25.1 |
| 2,407,854 | A | * | 9/1946 | Steingard | 403/110 |
| 2,559,421 | A | * | 7/1951 | Garrett | 135/28 |
| 3,345,786 | A | | 10/1967 | Buzzella | |
| 3,407,825 | A | | 10/1968 | Doyle | |
| 3,554,203 | A | | 1/1971 | Hall | |
| 3,604,734 | A | * | 9/1971 | Friedman | 287/58 |
| 3,662,771 | A | | 5/1972 | Gravatt | |
| 3,677,274 | A | | 7/1972 | Yasuda et al. | |
| 3,904,161 | A | | 9/1975 | Scott | |
| 4,188,965 | A | | 2/1980 | Morman | |
| 4,800,909 | A | | 1/1989 | Seidel et al. | |
| 4,998,841 | A | * | 3/1991 | Wilde | 403/104 |
| 5,188,331 | A | | 2/1993 | Baines | |
| D341,241 | S | | 11/1993 | Buckley | |
| 5,518,218 | A | | 5/1996 | Leonard | |
| 5,529,368 | A | | 6/1996 | Cui et al. | |
| 5,836,327 | A | | 11/1998 | Davis | |
| D405,292 | S | | 2/1999 | Reese | |
| 5,878,762 | A | | 3/1999 | Huang | |
| D413,429 | S | | 9/1999 | Carson | |
| 6,032,917 | A | | 3/2000 | Shannon | |
| 6,290,192 | B1 | * | 9/2001 | Messerli | 248/188.5 |

* cited by examiner

*Primary Examiner*—Carl D. Friedman
*Assistant Examiner*—Phi Dieu Tran
(74) *Attorney, Agent, or Firm*—Gifford, Krass, Groh, Sprinkle, Anderson & Citkowski, P.C.

(57) ABSTRACT

An umbrella device incorporating an engaging mechanism for securing the umbrella to fixed location. The device includes an elongated shaft having a top end and a bottom end and which is capable of being extended across an overall axial length. A fabric covering portion is supported by an outwardly actuable frame secured to the shaft, the frame including a plurality of elongate and arcuate ribs to which is secured the fabric covering portion. An annular collar is mounted about the elongated shaft in axially extending fashion. An additional plurality of supporting ribs extend from the collar, each of the supporting ribs engaging an associated fabric securing rib so that, upon a selected upward axial extension of the collar, the frame is engaged in the outwardly actuated manner. A substantially "C" shaped clamp is secured in axially slidable fashion along the extended axial length of the shaft, the clamp affixing the umbrella device to a substantially horizontally extending ledge support.

1 Claim, 4 Drawing Sheets

UMBRELLA DEVICE WITH ENGAGING MECHANISM

BACKGROUND OF THE INVENTION

1. Field of the Invention

The present invention relates generally collapsible umbrellas and coupling devices for securing umbrellas in an upwardly arrayed and extending fashion. More specifically, the present invention relates to an umbrella with an engaging mechanism incorporated within the umbrella for securing the umbrella to a fixed location and in an upwardly extending manner.

2. Description of the Prior Art

Folding umbrellas are well known in the art and which are designed to provide a degree of portable shading. The standard type of umbrella includes a main shaft having a top end and an opposite and curved handle end. A collar is slidably engaged along the substantial length of the shaft from between the handle end and a position proximate the top end. A plurality of elongate and arcuate skeletal portions are provided which make up the frame of the umbrella fabric covering portion and which extend in radially outward fashion from locations proximate the top end. A like plurality of ribbed portions extend in proximity to the axially slidable collar and interconnect at intermediate axial locations to each of the associated skeletal portions. A spring-loaded catch or locking tab of some form is typically provided at an upper end location of the main extending shaft and, upon coming into contact with the slidable annular collar, locks the collar in place at its elevated location and so that the pluralities of fabric supporting arcuate skeletal portions and interengaged and outwardly extending rib portions are locked in place.

An additional example of a coupling device for a collapsible sunshade umbrella is illustrated in U.S. Pat. No. 5,878,762, issued to Huang, and which includes a coupling base with a supporting column having a first end portion and a second end portion containing an insertion socket therein. Two juxtaposed extension ears each extends outwardly from the outer wall of the supporting column and is formed with a plurality of locking ribs. A pivot base includes a rotary block rotatably mounted between the two extension ears and including two sides, each containing a plurality of locking indents each receiving one of the plurality of locking ribs of each of the two extension ears, and a supporting tube fixedly mounted on the rotary block.

U.S. Des. Pat. No. 413,429, issued to Carson, illustrates a clamp for Supporting an umbrella and which appears to show a substantially "C" shaped frame having an axially extending and internally hollowed cylindrical sleeve integrally formed therewith. The presumption from the title of the invention is that the shaft or main body of the umbrella is insertingly engaged through the sleeve and the thumbscrew illustrated is employed to secure the clamp at a selected axial location along the umbrella sleeve. The clamp of Carson further illustrates a main and exteriorly threaded bolt which is interengageably and threadably secured through an appropriately sized aperture in the lower arm of the "C" shaped member. A pincer support attached to an extending end of the bolt includes an arcuately configured upper surface and, upon rotating the bolt to translating in one of two directions, is positioned in opposing fashion to a corresponding and arcuately configured inner facing surface of the upper arm of the "C" shaped member.

U.S. Pat. No. 5,836,327, issued to Davis, teaches an umbrella holder for grasping the lower and curved handle end of a conventional umbrella and which includes a clamp mechanism, a forward/rearward angular adjustment mechanism, a length adjustment mechanism, and an umbrella shaft and handle securing mechanism. The device of Davis is a separate device manufactured for use with the conventionally constructed umbrella.

U.S. Pat. No. 3,345,786, issued to Buzzella, teaches a vented metal umbrella of the type produced in knock-down or kit form for compact storage and shipment prior to assembly at the site of use. A generally vertical support structure includes a lower support tube, an upper support tube telescopingly received within the upper end of the lower tube. A knuckle member is affixed to an upper end of the upper support tube. A collar is secured to a location of the upper tube, at a position below the knuckle member, and includes a set screw extending through an opening in the tube for adjustably securing the upper support tube. An adjustable knuckle arm is also provided and secures in rotatably adjustable and end-to-end fashion to the knuckle member. An umbrella covering cone is secured to a circular flange extending from an upper end of the adjustable knuckle arm and by means of an intermediate mounted and umbrella support disc.

SUMMARY OF THE PRESENT INVENTION

The present invention is an umbrella device incorporating an integrally formed engaging mechanism for securing the umbrella to a fixed location. A main and elongated shaft is provided having a top end and a bottom end. A fabric covering portion is supported by an outwardly actuable frame secured to the shaft, the frame including a plurality of elongate and arcuate ribs to which is secured the fabric covering portion.

An annular collar is mounted about the elongated shaft in axially extending fashion, with an additional plurality of supporting ribs extending from the collar and engaging with associated fabric securing ribs so that, upon selected upward extension of the collar, the frame is engaged in the outwardly actuated manner. In one embodiment, the annular collar includes an interiorly threaded aperture formed through an annular side wall location. A tightening screw with externally threaded shaft portion is threadably interengaged within the aperture and so that an end face of the shaft portion abuttingly engages a selected upwardly extended location of the elongated shaft.

In a further embodiment, the annular collar includes an axially extending sleeve with an upwardly facing and annular edge and a windowed portion formed within the sleeve at a location proximate the annular edge. An inwardly actuable and outwardly spring-loaded tang extends from an annular surface location of the elongated shaft, the tang including a substantially level upper surface and an angled lower surface which coincides with the upper surface at a substantially pointed end. Upon selected upward axial extension of the collar, the annular edge inwardly actuates the tang, which subsequently aligns and extends outwardly to seat within the windowed portion.

The elongated shaft in one preferred embodiment includes an axially extending passageway containing, in telescopingly inserted fashion, an elongate and extensible rod. According to a second embodiment, a secondary elongated shaft is pivotally and adjustably secured to the bottom end of the main elongated shaft by first and second cylindrically shaped sleeve members arranged in end-to-end abutting fashion and through which is engaged an elongate carriage bolt. A bottom end of the extensible and/or secondary shafts may further be pointed to facilitate being forcibly engaged or embedded within a suitable ground location and so that the umbrella device is arrayed in a desired upwardly extending fashion.

A "C" shaped clamp is provided and includes a sleeve portion which is integrally formed with a body of the clamp. The sleeve is interengaged along the length of either the extensible or secondary shaft, according to the desired embodiment, and facilitates the engagement of the umbrella device to a substantially horizontally extending ledge support.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
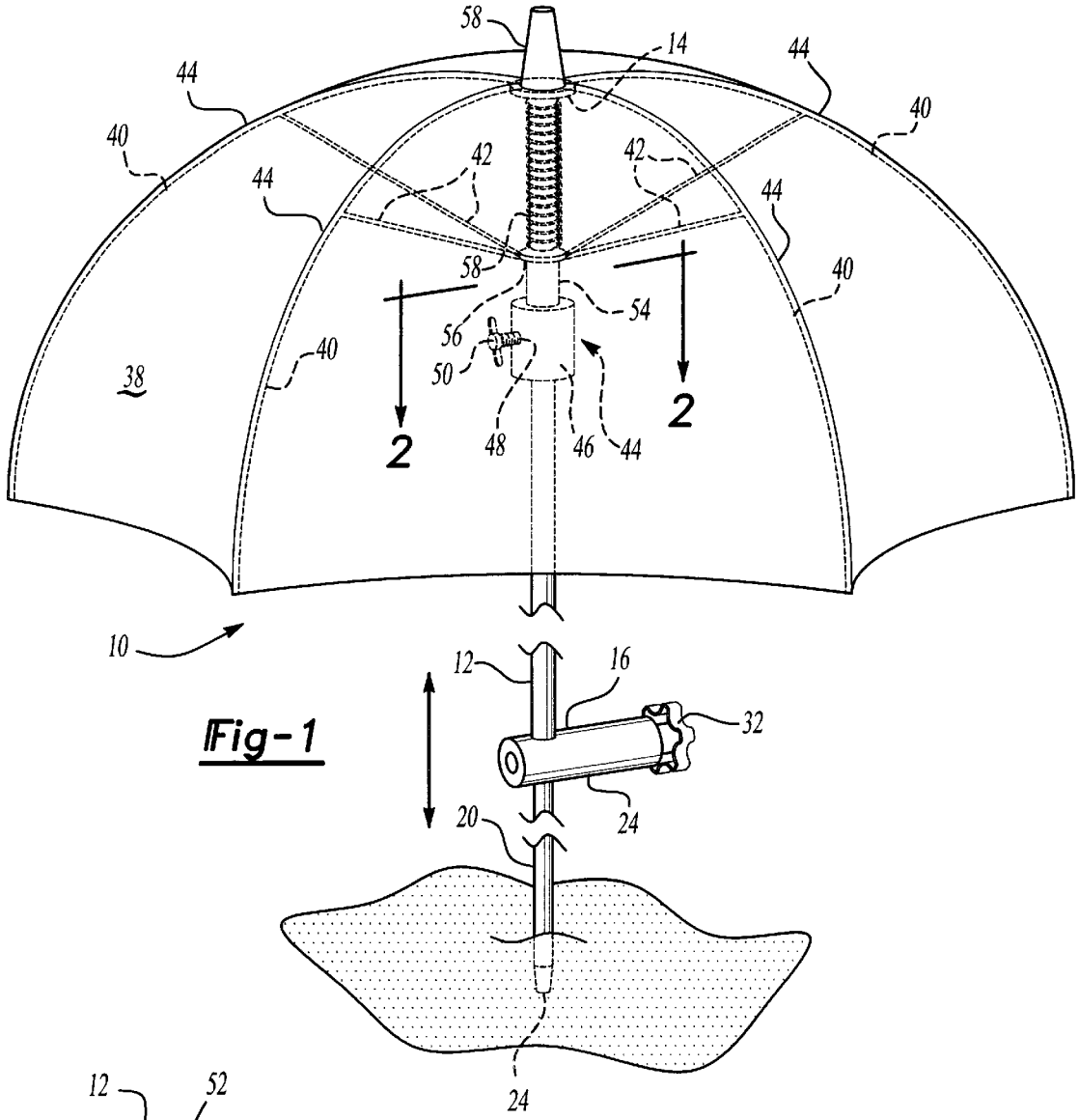
FIG. 1 is an overall perspective view, in reduced length, of the umbrella device according to a first preferred embodiment of the present invention.

With reference now to FIG. 1, an umbrella device is illustrated at 10 according to a first preferred embodiment of the present invention. The umbrella device 10 is illustrated in reduced length in FIG. 1 however, and referring further to FIGS. 3 and 4, a better representation of its overall length dimensions is illustrated not in reduced section.

Figure 2:
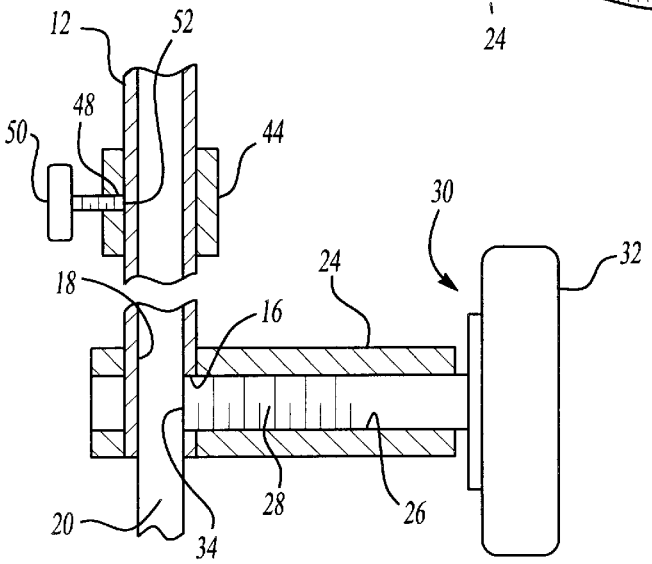
FIG. 2 is an enlarged partial view in section of the umbrella device according to FIG. 1 and further illustrating cross wise extending member integrally formed with the main shaft and which permits the extensible rod to be fixedly repositioned to selected axial locations relative the main shaft.

The umbrella device includes a main elongated shaft 12 having a top end 14 and a bottom end 16. The elongated shaft 12 is generally constructed of a durable material, such as a durable plasticized material or lightweight metal and, as is best illustrated in FIG. 2, also includes an axially extending passageway 18. Inserted within the axially extending passageway 18, in telescoping fashion, is an elongated and extensible rod 20 which includes a top end 20 and a generally tapered and pointed bottom end 22.

Referring again to FIGS. 1–4, and as is best illustrated in the enlarged cutaway of FIG. 2, a substantially cylindrical shaped and internally hollowed member 24 is illustrated and which is integrally formed with and extends in cross wise fashion from a location proximate the bottom end 16 of the main elongated shaft 12. A generally annular, elongated and interiorly defined surface 26 of the cross wise extending member 24 (see as best shown again in the cutaway of FIG. 2) is interiorly threaded so that an exteriorly threaded and extending shaft portion 28 of a tightening bolt 30 threadably engaging within the crosswise extending member and, by virtue of the communicating passageway established between a crosswise passageway defined by the interiorly defined surface 26 and the intersecting and axially extending passageway 18 of the main shaft 12, is capable of intersecting the telescoping path of the extensible rod 20.

Figure 3:
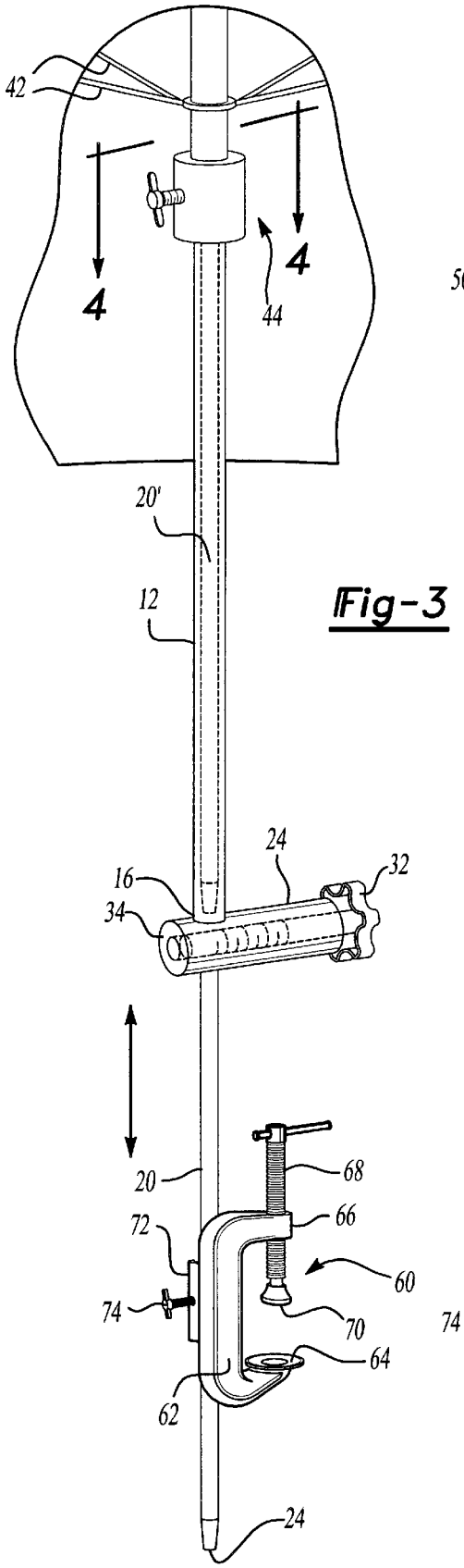
FIG. 3 is a generally elongated perspective view of the main shaft and extensible rod according to the first preferred embodiment and further illustrating the attachable "C" clamp for securing the umbrella device to a substantially horizontally extending ledge support.

The tightening bolt 30, threadably engaged within the cross wise extending member 24, further includes a tightening/loosening knob 32 and, at an opposite end thereof, an end face 34 of the extending shaft portion 28. In a first position, the knob 32 is fully tightened and so that the shaft 28 extends beyond the communicating and intersecting passageway 18 of the main shaft 12 and the annular facing surface of the shaft 28 supports and thereby telescopically restrains the extensible rod 20 completely within the axially extending interior of the main shaft 12. Reference is made to FIG. 3 and which illustrates, in phantom at 20', the extensible rod completely contained within the main shaft 12.

Figure 4:
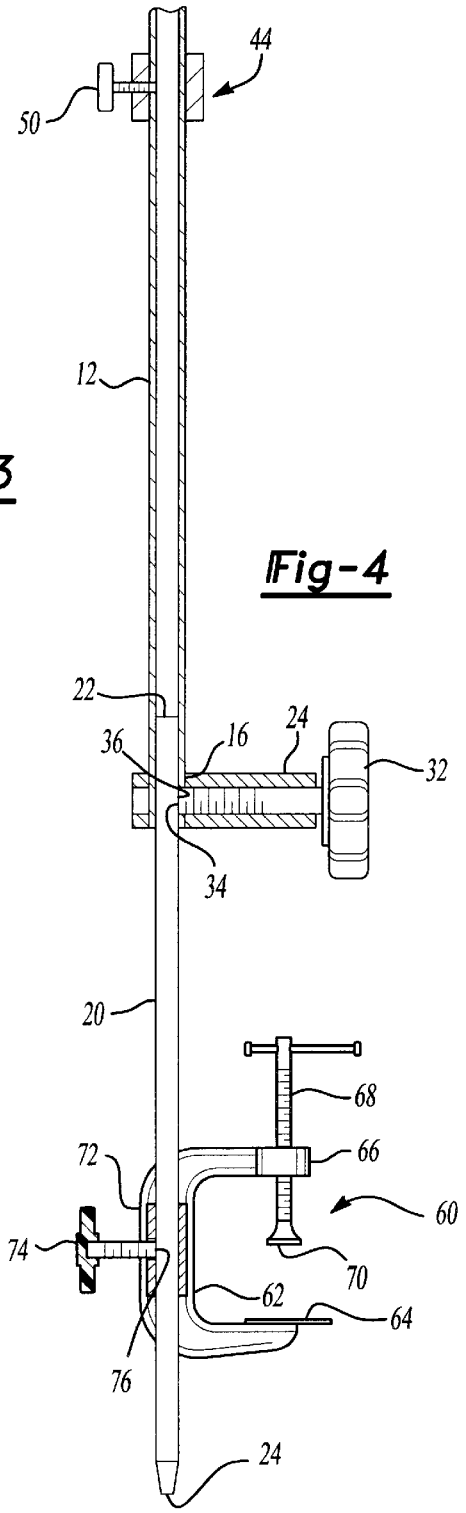
FIG. 4 is a cutaway view taken along line 4—4 of FIG. 3.

In a second position, the knob 32 is sufficiently loosened to permit a selected axial length of the extensible rod 20 (see as best shown in FIGS. 2 and 4) to extend beyond the communicating cross wise extending passageway of the cross wise extending member 24. The knob 32 is then retightened to a sufficient extent so that the end face 34 of the shaft portion 28 abuttingly engages against a selected axial location (see at 36 in FIG. 4) of the extensible rod 20. In its generally extended position, the generally tapered or pointed end 24 of the extensible rod 20 may be downwardly and forcibly engaged against the ground, see again FIG. 1, according to a first option.

Referring again to FIG. 1, a fabric covering portion is illustrated generally at 38 and is supported atop the elongated main shaft 12 by an outwardly actuable frame secured to the main shaft 12. The actuable frame includes a first plurality of elongate and arcuate shaped ribs 40 to which is secured the fabric covering portion, such being known according to conventional mounting or sewing techniques known in the art. The frame further includes another and like plurality of supporting ribs 42 having extending ends which engage intermediate locations of associated ribs 40.

The supporting ribs 42 are secured, at ends opposite their extending ends, to an annular collar 44 assembly mounted in axially slidable fashion about the elongate shaft 12. The annular collar 44 includes a first generally cylindrical shaped portion 46. An interiorly threaded aperture 48 is formed through an annular side wall location of the generally cylindrical shaped portion 46. A tightening screw 50 with an externally threaded shaft portion threadably interengages within likewise interiorly placed threads upon the aperture 48 so that an end face of the screw's shaft portion abuttingly engages a selected upwardly extended location of said elongated shaft 12, and such as is further illustrated at 52 in the cutaway of FIG. 2.

Referring again to FIG. 1, a further coaxially narrowed tubular portion forming a part of the collar assembly is illustrated, at 54, and terminates in a disk 56 to which is secured in circumferentially spaced fashion the opposite ends of the supporting ribs 42. Referring again to FIG. 1, a coil spring 58 may be employed in a desired variant and which biases the collar assembly 44 in a downward and closing direction. It is also envisioned that the spring 44 may be substituted for any other type of biasing means, such as another variation of a spring completely encapsulated within the elongated main shaft 12, or the spring 44 may be deleted in its entirety without affecting the overall operation of the umbrella device. An end cap 58 is illustrated secured atop the top end 14 of the main shaft and, upon the upward axial extension of the collar 44 and its engagement at the location illustrated in FIG. 1, such as by retightening the screw 50, the frame structure of the umbrella is in its substantially opened position with the fabric covering 38 substantially employed.

Referring again to FIGS. 3 and 4, an attachable clamp assembly is shown at 60 and which includes a generally "C" shaped body 62 having a lower abutting surface 64 and an upper mounting surface 66 to which is threadably engaged a downwardly rotatable and translatable screw 68 terminating in an opposing and abutting surface 70. A sleeve 72 is secured to a suitable location of the main body 62, such as by welding. Alternatively, the sleeve 72 may be integrally molded or cast along with the body 62 of the clamp. A tightening screw 74 with a threaded shaft portion is engageable within a likewise interiorly threaded and appropriately formed aperture in the sleeve 72 so that, upon slidably engaging the extensible rod 20 through the sleeve 72, the screw 72 is tightened and an end face 76 of the screw 72 (see cutaway of FIG. 4) abuttingly engages a selected outwardly facing annular location of the rod 20. The advantage of the attachable "C" clamp 60 is that it permits the umbrella device 10 to be secured to any appropriate and substantially horizontally extending ledge support (not shown in FIGS. 3 and 4) and as will be again explained with further reference to the embodiment of FIG. 5. It is also envisioned that the "C" clamp can be integrally formed or cast along with the extensible rod 20, however doing so would preclude the option of fully telescoping the rod 20 within the axial interior of the main shaft 12.

Figure 5:
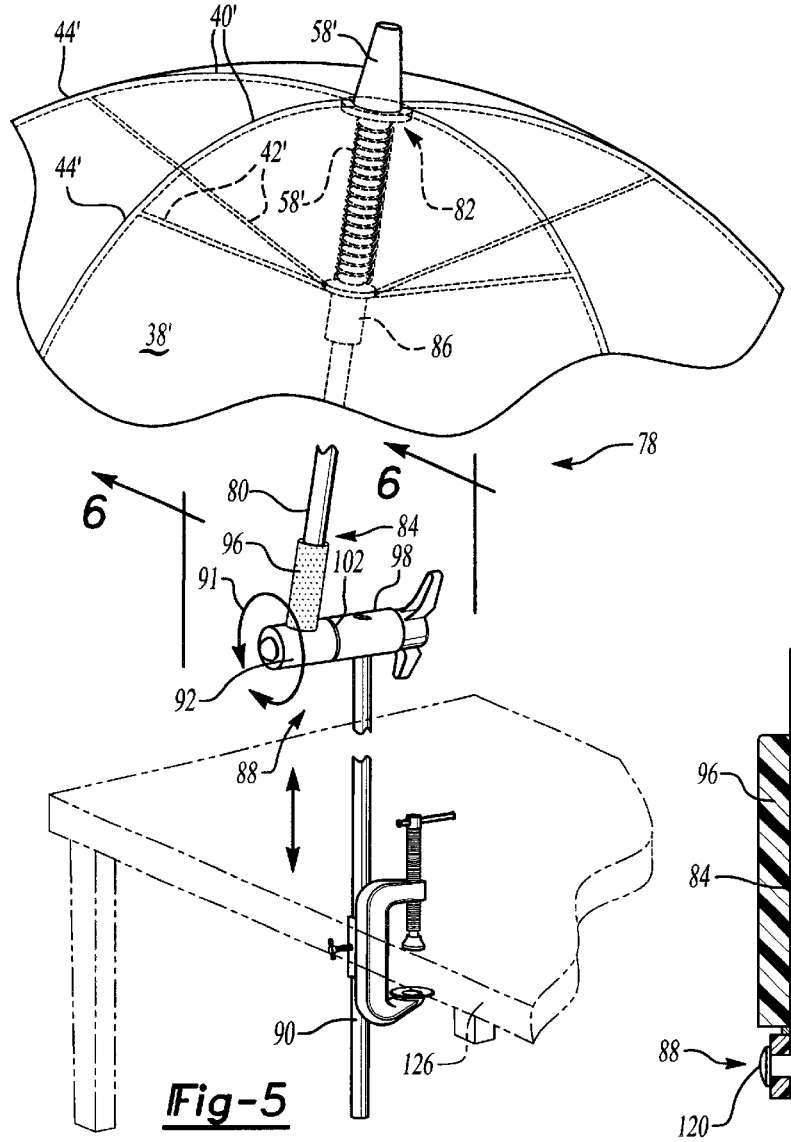
FIG. 5 is an overall perspective view, again in reduced length, of the umbrella device according to a second preferred embodiment of the present invention.

Referring now to FIG. 5, an umbrella device is illustrated at 78 according to a further preferred embodiment of the present invention and again includes a main and elongated shaft 80 with a top end 82 and a bottom end 84 and, similarly to the first preferred embodiment 10, includes a similarly designed fabric covering portion 38' and supporting frame with elongate and arcuate extending ribs 40' and supporting ribs 42' extending from an annular collar 86 and engaging mid-point locations 44' of associated ribs 40'. The annular collar 86 may also be of a conventional design known in the art and which is spring-loaded in an upwardly actuating manner. Alternatively, an annular collar of the type and construction previously illustrated with reference to 44 in FIGS. 1–4 or, alternatively, in the manner to be subsequently described with reference to FIGS. 8 and 9, may be substituted within the scope of the invention.

Referring again to FIGS. 5–7, a pivotally and adjustably securing mechanism is illustrated at 88 for securing a secondary and elongate extending shaft 90 to the bottom end 84 of the main or initial elongated shaft 80, and in a manner capable of being rotated as evidenced by circular extending arrow 91 in FIG. 5. The mechanism 88 includes a first cylindrically shaped sleeve member 92 secured to the bottom end 84 of the initial or main elongated shaft 80 and typically by a stud 94 extending in a crosswise direction from the first cylindrically shaped sleeve member 92, the stud 94 threadably engaging within an aperture 95 (see as best shown in exploded view of FIG. 7) formed within an associated bottom end of a tubular interconnecting element 96 mounted in turn to the bottom end 84 of the elongated shaft 80.

A second cylindrically shaped sleeve member is illustrated at 98 secured to a top end 100 of the secondary and pivotally associated shaft 90. A lock washer 102 with an annular extending and undulating ring edge is disposed between abutting end faces 104 and 106, respectively, of the first and second cylindrically shaped sleeve members 92 and 98, and such that a continuous internally passageway is defined (as best illustrated again in the exploded view of FIG. 7) between a first selected end 108 of the first sleeve member 92 and a second and opposite selected end 110 of the second sleeve member 98. Alternatively, it is envisioned that the lock washer 102 can be replaced by opposing and matingly engaging circumferential end face serrations (not shown) and which are formed in the opposing end faces 104 and 106 of the end to end abutting and cylindrically shaped sleeve members 92 and 98.

Figure 6:
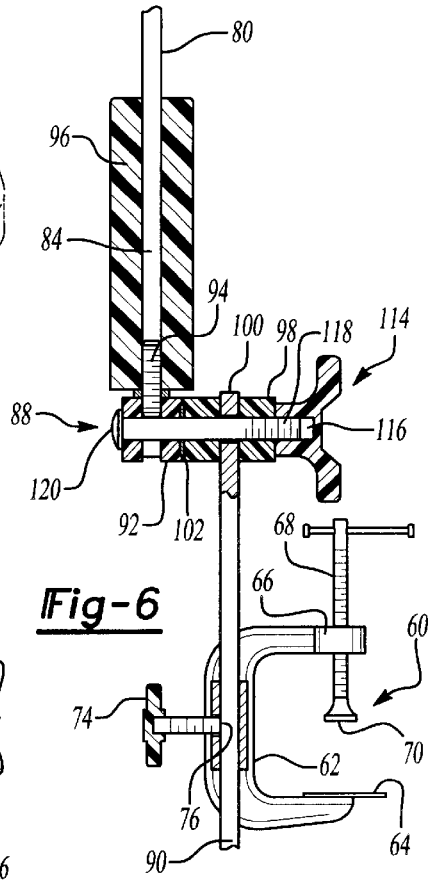
FIG. 6 is a cutaway view taken along line 6—6 of FIG. 5 and better illustrating the particulars of the pivotal adjustment mechanism for angling the extending umbrella portion relative the secondary elongated shaft.

A carriage bolt 112 is insertingly engaging through the continuous passageway defined by the first 92 and second 98 sleeve members and the interdisposed lock washer 102. A tightening knob 114 includes a body with an interiorly threaded recess 116 (see again FIG. 7) and is arrayed in abutting fashion against the selected end 110 of the second sleeve member 98. An exteriorly threaded end 118 of the carriage bolt 112 threadably interengages with the interiorly placed threads of the knob recess 116, concurrently with an enlarged bolt head 120 of the carriage bolt 112 abuttingly engaging against the first selected end 108 of the first sleeve member 92 (see as best shown in FIG. 6). An aperture 122 is formed through the secondary shaft 90 at a location proximate its top end 100 and upon insertion of the secondary shaft 90 in a cross wise fashion within an appropriate aperture 124 formed in a bottom side surface of the second sleeve member 98, the inserted carriage bolt 112 aligns with and extends through the aperture 122.

Again illustrated in the umbrella device 78 shown in FIGS. 5 and 6 is the substantially "C" shaped clamp 60 which is identical in presentation to that illustrated in the first preferred embodiment, therefore an identical description of its components is rendered unnecessary. As with the umbrella device 10 of the first embodiment, it is envisioned that the clamp 60, once mounted in the further embodiment 78 to a suitable location along the second and pivotally extending shaft 90, will provide the ability to affix the umbrella device to a substantially horizontally extending ledge support, such as being particularly shown in FIG. 5 as being a table edge 126.

Figure 8:
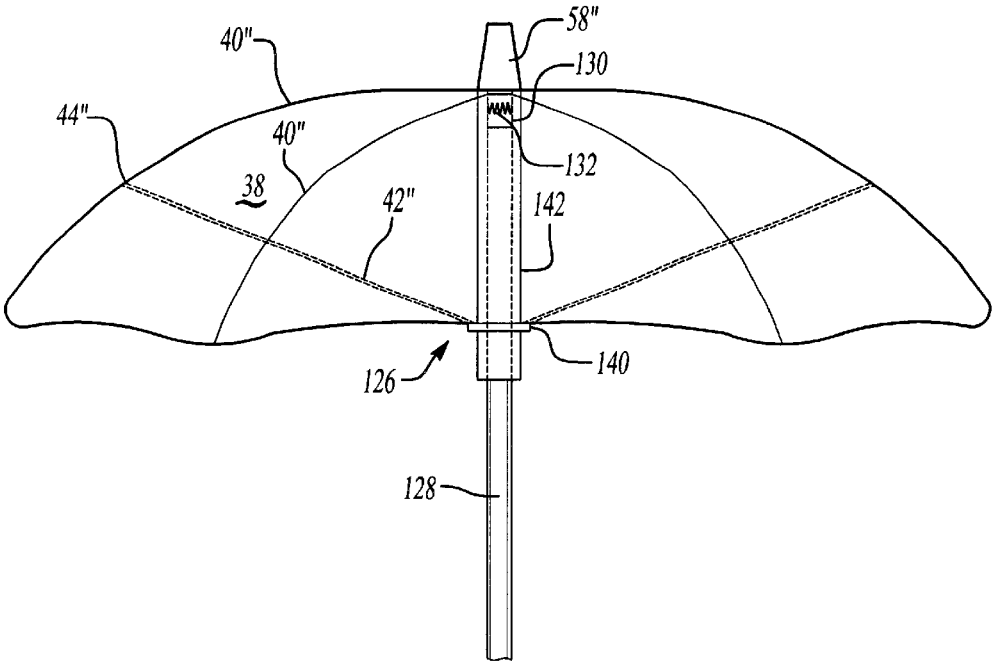
FIG. 8 is a plan view of an annular collar locking mechanism according to a further preferred variant of the present invention.
Figure 9:
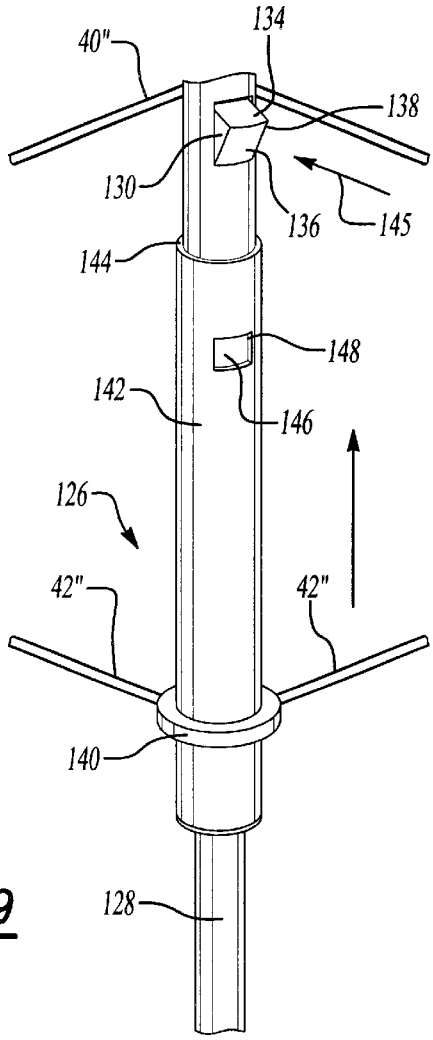
FIG. 9 is a sectional view in perspective of the interengagement of the annular collar with the upper end of the main shaft as also illustrated in FIG. 8.

Referring finally to FIGS. 8 and 9, a still further variant is illustrated for securing an annular collar assembly 126 in a fixed and upwardly extending position relative to a main shaft 128 of the umbrella device and which is telescopingly inserted therethrough. As best illustrated in FIG. 9, an inwardly actuable and outwardly spring-loaded tang 130 extends from an annular surface location of the elongated shaft 128. As is also shown in FIG. 8, a coil spring 132 is illustrated in cutaway embedded in a crosswise extending maimer within the main shaft 128 and biases the tang 130 in a cross wise and outward direction.

The configuration of the tang 130 is such that it includes a slightly angled upper surface 134 and an angled lower surface 136 which coincides with the upper surface 134 at a substantially pointed end 138 (see as best illustrated in FIG. 9). The annular collar assembly 126 further includes a generally disc shaped portion 140, from which circumferentially extends each of supporting ribs 42" of the actuating frame structure and which again further includes the main elongated and arcuate ribs 40" to which is secured the fabric 38" and which interengages with the supporting ribs 42", at the intermediate locations designated at 44".

An axially extending sleeve 142 is integrally formed with the supporting rib engagement portion 140 and extends upwardly a selected distance and terminates in an upwardly facing and annular edge 144. A windowed portion 146 is formed within a selected annular location of the sleeve 142 proximate the annular edge 144 and so that, upon selected upward axial extension of the collar assembly 126, the annular edge 144 inwardly actuates the tang 130 (see arrow 145 of FIG. 9) and by riding against the angled lower surface 136.

Once completely biased within the interior of the hollowed interior of the main shaft 128, the tang 130 subsequently aligns and extends outwardly to seat within the windowed portion 146 and to thereby lock the collar assembly 126 in place at its upwardly most actuated position. To facilitate subsequently release of the tang 130 from within the windowed portion, an upper horizontal edge 148 of the windowed portion may be angled in an upwardly and outwardly fashion (see again as best shown in FIG. 9) and which is sufficient to facilitate, along with the slight angling of the tang upper surface 134, to again bias the tang 130 to its inward-most recessed position so as to facilitate downward actuation of the collar assembly 128 to close the umbrella fabric covering portion and associated frame.

Figure 7:
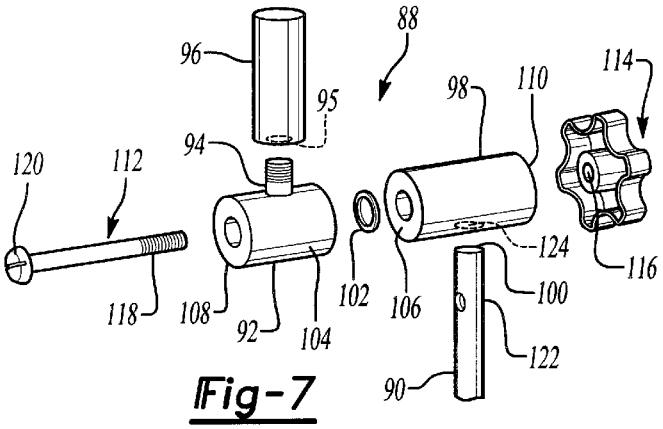
FIG. 7 is an exploded view of the adjustment mechanism illustrated in FIG. 6.

It is understood that the annular collar assembly 126 of the preferred variant may be incorporated into either of the main preferred embodiments of the umbrella device, as illustrated either at 10 in FIGS. 1–4, and at 78 in FIGS. 5–7, within the scope of the present invention. It is also understood that the present invention provides a novel and unique arrangement by which an umbrella device may be affixed either upon a suitable ground location or, alternatively, to a suitable horizontally extending support. Additional preferred embodiments will also become apparent to those skilled in the art to which it pertains and without deviating from the scope of the appended claims.

I claim:

1. An umbrella device having an engaging mechanism for securing the umbrella to a fixed location, said device comprising:

an elongated shaft having a top end, a bottom end and an axially extending passageway;

means for extending an overall axial length of said elongated shaft location at said bottom end, said extending means further comprising an elongate and extensible rod in telescopingly inserted fashion within said elongated shaft;

a substantially cylindrical shaped and internally hollowed member which is integrally formed with and extends in crosswise fashion from said elongated shaft, a tightening bolt including a knob end threadably engaging within said crosswise extending member and communicating with said axial passageway to engage selected locations along said extensible rod;

a fabric covering portion supported by an outwardly actuable frame secured to said shaft, said frame including a plurality of elongate and arcuate ribs to which is secured said fabric covering portion;

an annular collar mounted about said elongated shaft in axially extending fashion, and additional plurality of supporting ribs extending from said collar, each of said supporting ribs engaging an associated fabric securing rib so that, upon a selected upward axial extension of said collar, said frame is engaged in said outwardly actuated manner; and a substantially "C" shaped clamp and means for securing said clamp to an extended axial length location of said shaft, said clamp affixing said umbrella device to a substantially horizontally extending ledge support.

said elongate and extensible rod further comprising a generally pointed bottom end.

* * * * *